US006038420A

United States Patent [19]

Hirabayashi et al.

[11] Patent Number: 6,038,420

[45] Date of Patent: Mar. 14, 2000

[54] CHARGING DEVICE, CHARGING METHOD AND IMAGE FORMING APPARATUS

[75] Inventors: Jun Hirabayashi; Harumi Ishiyama, both of Numazu; Yasunori Chigono, Susono, all of Japan

[73] Assignee: Canon Kabushiki Kaisha, Tokyo, Japan

[21] Appl. No.: 09/128,537

[22] Filed: Aug. 4, 1998

[30] Foreign Application Priority Data

Aug. 4, 1997 [JP] Japan ..... 9-221946
May 14, 1998 [JP] Japan ..... 10-150608

[51] Int. Cl.[7] ..... G03G 15/02

[52] U.S. Cl. ..... 399/176; 361/225; 399/174

[58] Field of Search ..... 399/174, 175, 399/176; 361/225, 230

[56] References Cited

U.S. PATENT DOCUMENTS 5,432,037 7/1995 Nishikiori et al. ..... 430/126
5,579,095 11/1996 Yano et al. ..... 355/219
5,729,802 3/1998 Hirabayashi et al. ..... 399/174
5,774,769 6/1998 Chigono et al. ..... 399/176
5,815,777 9/1998 Hirabayashi ..... 399/174
5,860,040 1/1999 Shimizu et al. ..... 399/55
5,952,101 9/1999 Nishiguchi et al. ..... 428/402

FOREIGN PATENT DOCUMENTS 63-149669 6/1988 Japan .
6-3921 1/1994 Japan .
7-7994 1/1995 Japan .

*Primary Examiner*—Richard Moses
*Attorney, Agent, or Firm*—Fitzpatrick, Cella, Harper & Scinto

[57] ABSTRACT

A charging apparatus for charging a member to be charged includes an elastic member, the elastic member being press-contacted to a surface of the member to be charged, and electroconductive particles carried on the surface of the elastic member to which a charging voltage is applied, wherein a triboelectric charging property of the member to be charged relative to the elastic member is the same as a charging polarity of the charging apparatus.

9 Claims, 4 Drawing Sheets

CHARGING DEVICE, CHARGING METHOD AND IMAGE FORMING APPARATUS

FIELD OF THE INVENTION AND RELATED ART

The present invention relates to a charging device and charging method for charging a member to be charged, and to an image forming apparatus such as a copying machine or a printer.

More particularly, the present invention relates to an image forming apparatus of a contact charging type.

Heretofore, a corona type charger (corona discharging device) has been widely used as a charging apparatus for charging (inclusive of discharging) an image bearing member (member to be charged) such as an electrophotographic photosensitive member or an electrostatic dielectric recording member to a predetermined polarity and a predetermined potential level in an image forming apparatus, for example, an electrophotographic apparatus or an electrostatic recording apparatus.

The corona type charging device is a non-contact type charging device, and comprises a corona discharging electrode such as a wire electrode, and a shield electrode which surrounds the corona discharging electrode. It is disposed so that corona discharging opening thereof faces an image bearing member, that is, a member to be charged. In usage, the surface of an image bearing member is charged to a predetermined potential level by being exposed to discharge current (corona shower) generated as high voltage is applied between the corona discharging electrode and the shield electrode.

Recently, it has been proposed to employ a contact type charging apparatus as a charging apparatus for charging the image bearing member, that is, the member to be charged. This is due to the fact that contact type charging apparatus has an advantage over a corona type charging apparatus in terms of low ozone production, low power consumption, or the like. Also, such a contact type charging apparatus has been put to practical use.

In order to charge a member such as an image bearing member with the use of a contact type charging apparatus, the electrically conductive charging member (contact type charging member, contact type charging device, or the like) of a contact type apparatus is placed in contact with the member to be charged, and an electrical bias (charge bias) of a predetermined level is applied to this contact type charging member so that surface of the member to be charged is charged to a predetermined polarity and a predetermined potential level. The charging member is available in various forms, for example, a roller type (charge roller), a fur brush type, a magnetic brush type, a blade type, and the like.

When a member is electrically charged by a contact type charging member, two types of charging mechanisms (charging mechanism or charging principle:

(1) mechanism which discharges electrical charge, and (2) mechanism for injecting charge, come into action.

Thus, the characteristics of each of contact type charging apparatuses or methods are determined by the charging mechanism which is the dominant one of the two in charging the member.

(1) Electrical discharge based charging type or mechanism

In this charging mechanism, the surface of a member to be charged is charged by electrical discharge which occurs across a microscopic gap between a contact type charging member and the member to be charged.

In the case of the electrical discharge based charging mechanism, there is a threshold voltage which must be surpassed by the charge bias applied to a contact type charging member before electrical discharge occurs between a contact type charging member and a member to be charged, and therefore, in order for the member to be charged through the electrical discharge based charging mechanism, it is necessary to apply to the contact type charging member a voltage with a value greater than the value of the potential level to which the member is to be charged. Thus, in principle, when the electrical discharge based charging mechanism is in action, the discharge product is unavoidable, that is, active ions such as ozone ions are produced, even though the amount thereof is remarkably small.

(2) Direct charge injection type or mechanism

This is a mechanism in which the surface of a member to be charged is charged by electrical charge directly injecting into the member to be charged, with the use of a contact type charging member. Thus, this mechanism is called "direct charging mechanism", or "charge injection mechanism".

More specifically, a contact type charging member with medium electrical resistance is placed in contact with the surface of a member to be charged to directly inject electrical charge into the surface portion of the member to be charged, without relying on electrical discharge, in other words, without using electrical discharge in principle. Therefore, even if the value of the voltage applied to a contact type charging member is below the discharge starting voltage value, the member to be charged can be charged to a voltage level which is substantially the same as the level of the voltage applied to the contact type charging member. This injection charging mechanism does not suffer from the problems caused by the by-product of electrical discharge since it is not accompanied by ozone production.

However, in the case of this charging mechanism, the state of the contact between a contact type charging member and a member to be charged greatly affects the manner in which the member is charged, since this charging mechanism is an injection charging at the contact portion. Thus, this direct injection charging mechanism should comprise a contact type charging member composed of high density material, and also should be given a structure which provides a large speed difference between the charging member and the object to be charged, so that given point on the surface of the object to be charged makes contact with a larger area of the charging member.

A) Charging apparatus with charge roller

In the case of a contact type charging apparatus, a roller charge system, that is, a charging system which employs an electrically conductive roller (charge roller) as a contact type charging member, is widely used because of its desirability in terms of safety.

As for the charging mechanism in this roller charge system, the aforementioned (1) charging mechanism, which discharges electrical charge, is dominant.

Charge rollers are formed of rubber or foamed material with substantial electrical conductivity, or electrical resistance of a medium level. In some charge rollers, the rubber or foamed material is layered to obtain a specific characteristic.

In order to maintain stable contact between a charge roller and an object to be charged (hereinafter, "photosensitive member"), a charge roller is given elasticity, which in turn increases frictional resistance between the charge roller and the photosensitive member. Also in many cases, a charge roller is rotated by the rotation of a photosensitive drum, or is individually driven at a speed slightly different from that of the photosensitive drum. As a result, problems occur: absolute charging performance declines, the state of the contact between the charge roller and the photosensitive drum becomes less desirable, and foreign matter adheres to the charge roller and/or the photosensitive member. With conventional charging roller, the dominant charging mechanism through which a roller charging member charged a member to be charged was a corona charging mechanism.

FIG. 4 is a graph which shows an example of efficiency in contact type charging. In the graph, the abscissas represents the bias applied to a contact type charging member, and the axis of ordinate represents the potential levels correspondent to the voltage values of the bias applied to the contact type charging member.

The characteristics of the conventional charging by a roller are represented by a line designated by a character A. According to this line, when a charge roller is used to charge an object, the charging of an object occurs in a voltage range above an electric discharge threshold value of approximately −500 V. Therefore, generally, in order to charge a member to a potential level of −500 V with the use of a charge roller, either a DC voltage of −1,000 V is applied to the charge roller, or an AC voltage with a high peak-to-peak voltage such as 1,200 V, in addition to a DC voltage of −500 V, is applied to the charge roller to keep the difference in potential level between the charge roller and the member to be charged, at a value greater than the electric discharge threshold value, so that potential of the photosensitive drum converges to the desired potential level.

More specifically, in order to charge a photosensitive drum with a 25 microns thick organic photoconductor layer by pressing a charge roller upon the photosensitive member, charge bias with a voltage value of approximately 640 V or higher should be applied to the charge roller. Where the value of the charge bias is approximately 640 V or higher, the potential level at the surface of the photosensitive member is proportional to the level of the voltage applied to the charge roller; the relationship between the potential level and the voltage applied to the charge roller is linear. This threshold voltage is defined as a charge start voltage $V_{th}$.

In other words, in order to charge the surface of a photosensitive member to a potential level of V[−]d[−] which is necessary for electrophotography, a DC voltage of (V[−]d[−]+V[−]th[−]), which is higher than the voltage level to which the photosensitive member is to be charged, is necessary. Hereinafter, the above described charging method in which only DC voltage is applied to a contact type charging member to charge a member will be called "DC charging method".

However, with the use of the DC charging method, it was difficult to bring the potential level of a photosensitive member exactly to a target level, since the resistance value of a contact charging member changed due to changes in ambience or the like, and also the threshold voltage V[−]th [−] changed as the photosensitive member was shaved away.

As for a counter measure for the above described problem, Japanese Laid-Open Patent Application No. 149, 669/1988 discloses an invention which deals with the above problem to effect more uniform charging of a photosensitive member. According to this invention, a "AC charging method" is employed, in which a compound voltage composed of a DC component equivalent to a desired potential level V[−]d[−], and an AC component with a peak-to-peak voltage which is twice the threshold voltage V[−]th[−], is applied to a contact type charging member. This is intended to utilize the averaging effect of alternating current. That is, the potential of a member to be charged is caused to converge to the V[−]d[−], that is, the center of the peaks of the AC voltage, without being affected by external factors such as operational ambience.

However, even in the case of the contact type charging apparatus in the above described invention, the principal charging mechanism is a charging mechanism which uses electrical discharge from a contact type charging member to a photosensitive member. Therefore, as already described, the voltage applied to the contact type charging member needs to have a voltage level higher than the voltage level to which the photosensitive member is to be charged. Thus, ozone is generated, although only in a small amount.

Further, when AC current is used so that member is uniformly charged due to the averaging effect of AC current, the problems related to AC voltage become more conspicuous. For example, more ozone is generated; noises traceable to the vibration of the contact type charging member and the photosensitive drum caused by the electric field of AC voltage increase; the deterioration of the photosensitive member surface caused by electrical discharge increases, which add to the prior problems.

B) Charging apparatus with fur brush

In the case of this charging apparatus, a charging member (fur brush type charging device) with a brush portion composed of electrically conductive fiber is employed as the contact type charging member. The brush portion composed of electrically conductive fiber is placed in contact with a photosensitive member as an object to be charged, and a predetermined charge bias is applied to the charging member to charge the peripheral surface of the photosensitive member to a predetermined polarity and a predetermined potential level.

Also in the case of this charging apparatus with a fur brush, the dominant charging mechanism is the electrical discharge based charging mechanism.

It is known that there are two type of fur brush type charging devices; a fixed type and a roller type. In the case of the fixed type, fiber with medium electrical resistance is woven into foundation cloth to form pile, and a piece of this pile is adhered to an electrode. In the case of the rotatable type, the pile is wrapped around a metallic core. In terms of fiber density, pile with a density of 100 fiber/mm[+]2[+] can be relatively easily obtained, but the density of 100 fiber/mm[+]2[+] is not sufficient to create a state of contact which is satisfactory to charge a member by charge injection. Further, in order to give a photosensitive member satisfactorily uniform charge by charge injection, velocity difference which is almost impossible to attain with the use of a mechanical structure must be established between a photosensitive drum and a roller type fur brush. Therefore, the fur brush type charging device is not practical.

The relationship between the DC voltage applied to a fur brush type charging member and the potential level to which a photosensitive member is charged by the DC voltage applied to the fur brush shows a characteristic represented by a line B in FIG. 4. As is evident from the graph, also in the case of the contact type charging apparatus which comprises a fur brush, whether the fur brush is of the fixed type or the roller type, the photosensitive member is charged mainly through electrical discharge triggered by applying to the fur brush a charge bias the voltage level of which is higher than the potential level desired for the photosensitive member.

C) Magnetic brush type charging apparatus

A charging apparatus of this type comprises a magnetic brush portion (magnetic brush based charging device) as the contact type charging member. A magnetic brush is constituted of electrically conductive magnetic particles magnetically confined in the form of a brush by a magnetic roller or the like. This magnetic brush portion is placed in contact with a photosensitive member as an object to be charged, and a predetermined charge bias is applied to the magnetic brush to charge the peripheral surface of the photosensitive member to a predetermined polarity and a predetermined potential level.

In the case of this magnetic brush type charging apparatus, the dominant charging mechanism is the charge injection mechanism (2).

As for the material for the magnetic brush portion, electrically conductive magnetic particles, the diameters of which are in a range of 5–50 microns, are used. With the provision of sufficient difference in peripheral velocity between a photosensitive drum and a magnetic brush, the photosensitive member can be uniformly charged through charge injection.

In the case of a magnetic brush type charging apparatus, the photosensitive member is charged to a potential level which is substantially equal to the voltage level of the bias applied to the contact type charging member, as shown by a line C in FIG. 4.

However, a magnetic brush type charging apparatus also has its own problems. For example, it is complicated in structure. Also, the electrically conductive magnetic particles which constitute the magnetic brush portion become separated from the magnetic brush and adhere to a photosensitive member.

Japanese Patent Publication Application No. 3,921/1994 discloses a contact type charging method, according to which a photosensitive member is charged by injecting electric charge into the charge injectable surface layer thereof, more specifically, into the traps or electrically conductive particles in the charge injectable surface layer. Since this method does not rely on electrical discharge, the voltage level necessary to charge the photosensitive member to a predetermined potential level is substantially the same as the potential level to which the photosensitive member is to be charged, and in addition, no ozone is generated. Further, since AC voltage is not applied, there is no noise traceable to the application of AC voltage. In other words, a magnetic brush type charging system is an excellent charging system superior to the roller type charging system in terms of ozone generation and power consumption, since it does not generate ozone, and uses far less power compared to the roller type charging system.

D) Toner recycling process (cleanerless system)

In a transfer type image forming apparatus, the toner which remains on the peripheral surface of a photosensitive member (image bearing member) after image transfer is removed by a cleaner (cleaning apparatus) and becomes waste toner. Not only for obvious reasons, but also for environmental protection, it is desirable that waste toner is not produced. Thus, a cleanerless image forming apparatuses has been developed. In such an image forming apparatus, a cleaner is eliminated, and the toner which remains on the photosensitive member after image transfer is removed from the photosensitive drum by a developing apparatus; the residual toner on the photosensitive member is recovered by a developing apparatus at the same time as a latent image on the photosensitive drum is developed by the developing apparatus, and then is reused for development.

More specifically, the toner which remains on a photosensitive member after image transfer is recovered by fog removal bias (voltage level difference V[−]back[−] between the level of the DC voltage applied to a developing apparatus and the level of the surface potential of a photosensitive member) during the following image transfer. According to this cleaning method, the residual toner is recovered by the developing apparatus and is used for the following image development and thereafter; the waste toner is eliminated Therefore, the labor spent for maintenance is reduced. Further, being cleanerless is quite advantageous in terms of space, allowing image forming apparatuses to be substantially reduced in size.

In the cleanerless system, the untransferred toner is not removed from photosensitive member surface by a cleaner provided exclusively therefor, but is fed to the developing device passing by the charging means portion, and then is reused for the development process again, and therefore, in the case that contact charging is used as the charging means for the photosensitive member, the developer which is insulative exists in the contact portion between the contact charging member and the photosensitive member. In this case, there arises a problem of how to charge the photosensitive member. In the above-described roller charging or fur brush charging, the untransferred toner is scattered into non-pattern distribution on the photosensitive member, and a high bias voltage is applied to effect charging with the use of electric discharge in many cases. In the magnetic brush charging, powder is used as the contact charging member, and therefore, the magnetic brush portion of the electroconductive magnetic particle (powder) is softly contacted to the photosensitive member to charge the photosensitive member, but the equipment structure is complicated, and the problem attributable to the drop of the electroconductive magnetic particle constituting the magnetic brush portion is significant.

E) coating of contact type charging member with electrically conductive powder

Japanese Patent Application Publication No. 7994/1995 discloses a contact type charging apparatus with such a structure that coats a contact type charging member with electrically conductive powder, on the surface which comes in contact with the surface of a member to be charged, so that surface of the member to be charged is uniformly charged, that is, without irregularity in charge. The contact type charging member in this charging apparatus is rotated by the rotation of the member to be charged, and the amount of ozone generated by this charging apparatus is remarkably small compared to the amount of ozonic products generated by a corona type charging apparatus such as scorotron. However, even in the case of this charging apparatus, the principle, based on which a member is charged, is the same as the principle, based on which a member is charged by the aforementioned charge roller; in other words, a member is charged by electrical discharge. Further, also in the case of this charging apparatus, in order to assure that member to be charged is uniformly charged, compound voltage composed of DC component and AC component is applied to the contact type charging member, and therefore, the amount of ozonic products traceable to electrical discharge becomes relatively large. Thus, even this contact type charging apparatus is liable to cause problems; for example, images are affected by ozonic products, appearing as if flowing, when this charging apparatus is used for an extended period of time, in particular, when this charging apparatus is used in a cleanerless image forming apparatus for an extended period of time.

U.S. Pat. No. 5,432,037 discloses an image forming method using a contact charging wherein in order to avoid the charging problem due to deposition of the fine silica particles or toner particles during repeated long term image formation on the surface of the charging means, the developer contains at least visualizing particles and electroconductive particles having an average particle size smaller than that of the visualizing particles. However, the contact charging is based on the discharge-charging mechanism rather than the direct injection charging mechanism, and therefore, involves the above-described problems attributable to the discharging.

As described in the preceding paragraphs regarding the technologies prior to the present invention, it is difficult to effect the injection charging with the use of a contact type charging apparatus with a simple structure which comprises a contact type charging member such as a charge roller or a fur brush, since sufficiently close contact between the charging member and the member to be charged is not assured because of the roughness of the surface of the contact charging member.

In view of this, in the contact charging, even if a simple member such as a charging roller, furbrush or the like is used as the contact charging member, a simple structure for ozoneless injection charging with low applied voltage is desired in which stabilized injection charging is accomplished with high uniform charging property for long term.

Contamination of the contact charging member is an impeding factor against the injection charging, in an image forming apparatus of transfer type using a contact charging type, that is, a contact charging device as the charging means for the image bearing member.

Even in an image forming apparatus provided with a cleaner exclusively for the removal of the residual developer after the image transfer, not 100% of the residual developer is removed by the cleaner, but a part of the residual developer passes beyond the cleaner and is carried over to the charge portion where the contact charging member and the image bearing member are contacted to each other, with the result that contact charging member is contaminated with the developer by the developer being deposited on or mixed into the contact charging member. Usually, the conventional developers are insulative, and therefore, the contamination with developer of the contact charging member will result in improper charging.

In a cleanerless type image forming apparatus, there is not provided a cleaner exclusively for removing the residual developer from the image bearing member surface after the image transfer, the contact charging member is contaminated with a greater amount of the developer than in the image forming apparatus having the cleaner, so that obstruction by the residual developer is more significant.

The deposition force between the developer and the contact charging member such as a charging roller is so large that application, to the contact charging member, of the bias for discharging the developer is not enough to restore the satisfactory charging property.

When the improper charging occurs, the developer mixing into the contact charging member is further increased, so that improper charging is even worse.

Here, the problems are that surface of the contact charging member such as a simple charging roller or the like is too rough and that deposition force between the contact charging member and the developer is so large that contamination with developer of the contact charging member is not improved.

SUMMARY OF THE INVENTION

Accordingly, it is a principal object of the present invention to provide a charging device and a charging method which has high uniform charging property for long term with stability even if a simple member such as a charging roller, a fiber brush or the like is used as the charging member.

It is another object of the present invention to provide a charging device and a charging method wherein charging can be effected without ozone production with low applied voltage to the charging member.

It is a further object of the present invention to provide a charging device and a charging method which can effect an injection charging from the charging member to the member to be charged at low cost.

It is a further object of the present invention to provide a charging device and a charging method wherein the defect due to the ozone product is suppressed.

It is a further object of the present invention to provide a charging device and a charging method wherein charging noise is not generated.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, embodiments of the present invention will be described with reference to the drawings.

Figure 1:
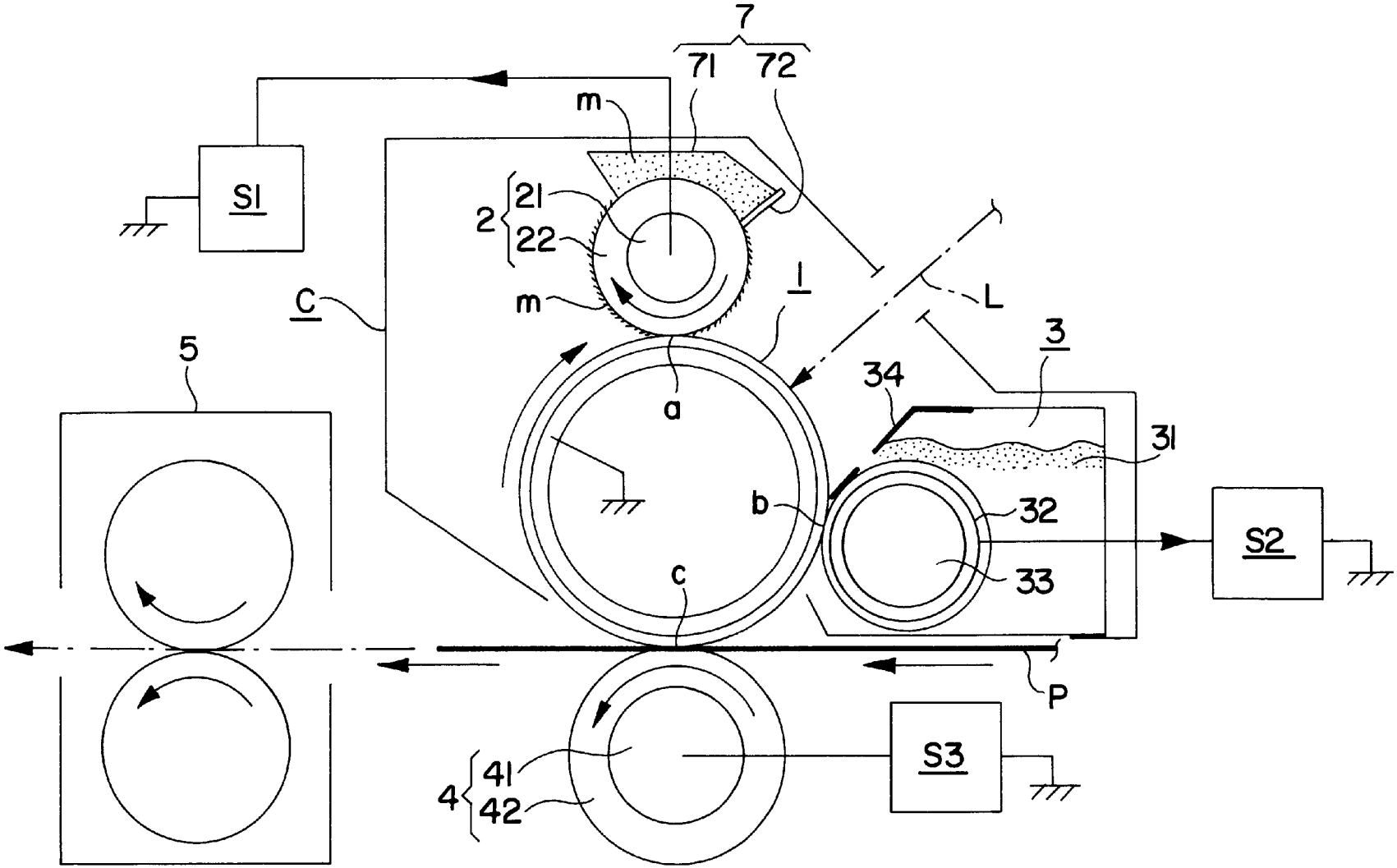
FIG. 1 is a schematic illustration of an image forming apparatus according to Embodiment 1.

Embodiment 1 (FIG. 1)

FIG. 1 is a schematic section of an image forming apparatus in accordance with the present invention, and depicts the general structure of the apparatus.

The image forming apparatus in this embodiment is a laser printer, which uses a transfer type electrophotographic process, a contact type charging system, a reversal type development process, a cleanerless cleaning system, and a process cartridge.

The special characteristic of this apparatus is that the electrical charge is injected into the image bearing member by placing electrically conductive charging process facilitating particles at least between the contact type charging member and the image bearing member, and also that when the contact type charging member is placed in contact with the image bearing member, without placing the charging process facilitating particles between the contact type charging member and the image bearing member, the image bearing member is triboelectrically charged to the same polarity as the polarity of the voltage applied to charge the image bearing member.

(1) General Structure of Printer

Image Bearing Member

Referential FIG. 1 designates an electrophotographic photosensitive member, as an image bearing member (member to be charged), in the form of a rotational cylinder. The printer in this embodiment uses a reversal development process. The photosensitive drum 1 in this embodiment uses negatively chargeable photosensitive material (OPC), and has a diameter of 30 mm. It is rotatively driven in the clockwise direction indicated by an arrow mark, at a peripheral velocity of 94 mm/sec.

Charging Process

Figure 2:
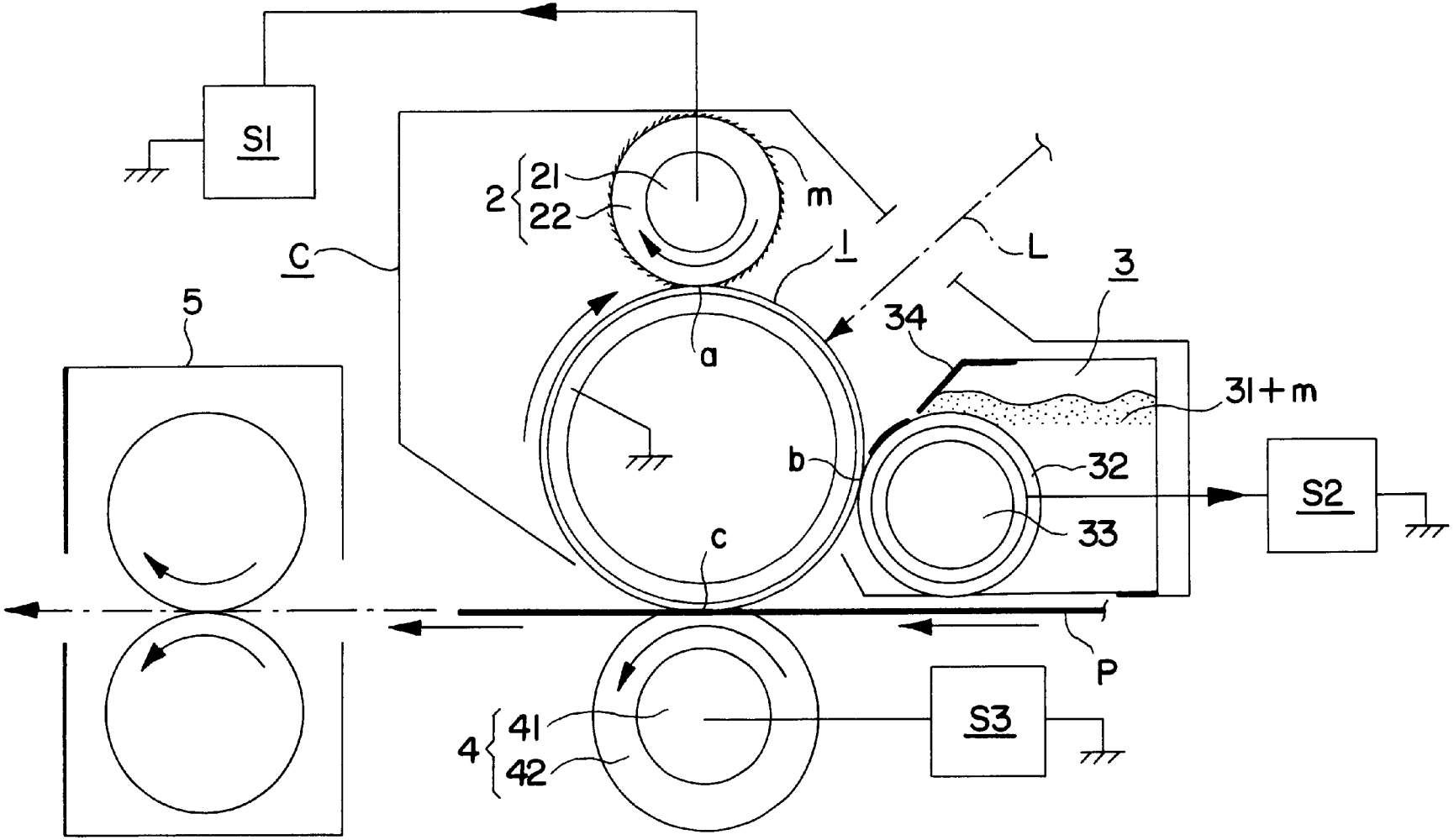
FIG. 2 is a schematic illustration of an image forming apparatus according to Embodiment 2.

Referential FIG. 2 designates an electrically conductive elastic roller (charge roller), as an elastic contact type charging member, which is placed in contact with the photosensitive drum 1 in a manner to generate a predetermined contact pressure. Referential character a designates a charging nip between the photosensitive drum 1 and the charging roller 2. The charging roller 2 bears charging process facilitator particles on the peripheral surface. These charging process facilitating particles m are coated in advance on the charging roller 2. In the charging nip a, charging process facilitating particles m are present.

Referential FIG. 7 designates an apparatus for coating the charging process facilitating particles m on the charging roller 2. The proper amount of charging process facilitating particles m is placed in a charging process facilitating particle container 71, and the peripheral surface of the rotating charging roller 2 is coated with the proper amount of the charging process facilitating particles m by an elastic blade 72.

In this embodiment, the charging roller 2 is rotatively driven in such a manner that its peripheral velocity equals 100% of the peripheral velocity of the photosensitive drum 1, and its rotational direction in the charging nip a becomes opposite (counter) to the rotational direction of the photosensitive drum 1 in the charging nip a. Thus, there is a velocity difference between the peripheral surfaces of the photosensitive drum 1 and the charging roller 2. To this charging roller 2, a predetermined charge bias is applied from a charge bias power source S1, and as a result, electrical charge is injected into the peripheral surface of the photosensitive drum 1, uniformly charging the peripheral surface of the photosensitive drum 1 to a predetermined polarity and potential level. In this embodiment, charge bias is applied from the charge bias power source S1 to the charging roller 2 so that the peripheral surface of the photosensitive drum 1 is virtually uniformly charged to −700 V.

The charging roller 2, the charging process facilitating particle m, the charge injection process, and the like will described in detail in other sections.

Exposing Process

The charged surface of the photosensitive drum 1 is scanned by (exposed to) a laser beam L projected from an unillustrated laser beam scanner, which comprises a laser diode, a polygon mirror, and the like. The laser beam projected from the laser beam scanner is a laser beam, the intensity of which has been modulated with sequential electrical digital image signals which reflect the pertinent image formation data, and as the peripheral surface of the photosensitive drum 1 is exposed to this scanning laser beam L, an electrostatic latent image correspondent to the pertinent image formation data is formed on the peripheral surface of the photosensitive drum 1.

In this embodiment, a reversal development process is used. In other words, among the regions of the peripheral surface of the photosensitive drum, the regions exposed to the scanning laser beam L while the intensity of the laser beam is high develop into an object, and the regions exposed to the scanning laser beam L while the intensity of the laser beam is low or substantially zero develop into the background.

Developing Process

Figure 3:
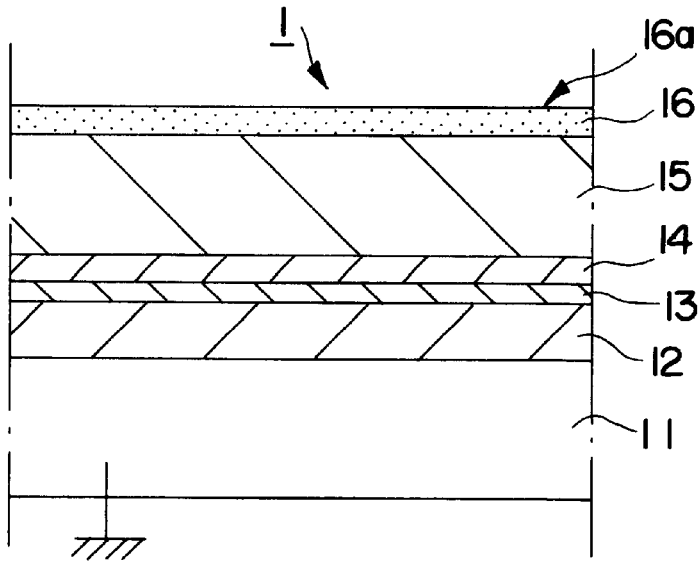
FIG. 3 schematically shows a layer structure of an example of a photosensitive member having a charge injection layer at the surface.

Referential FIG. 3 stands for a reversal type developing apparatus, which adheres developer (toner) to the peripheral surface of the rotating photosensitive drum 1 in proportion to the intensity of the exposure; in other words, the electrostatic latent image formed on the peripheral surface of the rotating photosensitive drum 1 is developed in reverse by the apparatus.

In this embodiment, the developing apparatus 3 uses negatively chargeable, dielectric, nonmagnetic single component developer, as developer 31. The average particle size of the developer is 7 $\mu$m.

Referential FIG. 32 designates a nonmagnetic development sleeve, which has a diameter of 16 mm, and contains a magnet 33. The developer 31 is coated onto this development sleeve 32. The development sleeve 33 is positioned so that the gap between the peripheral surfaces of the development sleeve 33 and the photosensitive drum 1 becomes 500 $\mu$m. In developing a latent image, the development sleeve 33 is rotated at the same peripheral velocity as the photosensitive drum 1, and development bias is applied to the development sleeve 33 from the development bias power source S2.

While the developer 31 coated on the peripheral surface of the development sleeve 33 is carried toward the development zone by the rotation of the development sleeve 33, the developer 31 is regulated in thickness by an elastic blade 34 (regulating blade), and as the developer 31 is regulated by the elastic blade 34, it is charged by the friction caused by the elastic blade 34.

As for development bias voltage, a compound voltage composed of a DC voltage of −420 V, an AC voltage having a frequency of 1600 Hz, a peak-to-peak voltage of 1600 V, and a rectangular wave form, is used. The type of developing method used in this embodiment is a jumping type method, which causes the single component developer to jump across the gap between the peripheral surfaces of the development sleeve 33 and the photosensitive drum 1, in the development zone.

Transferring Process

Figure 4:
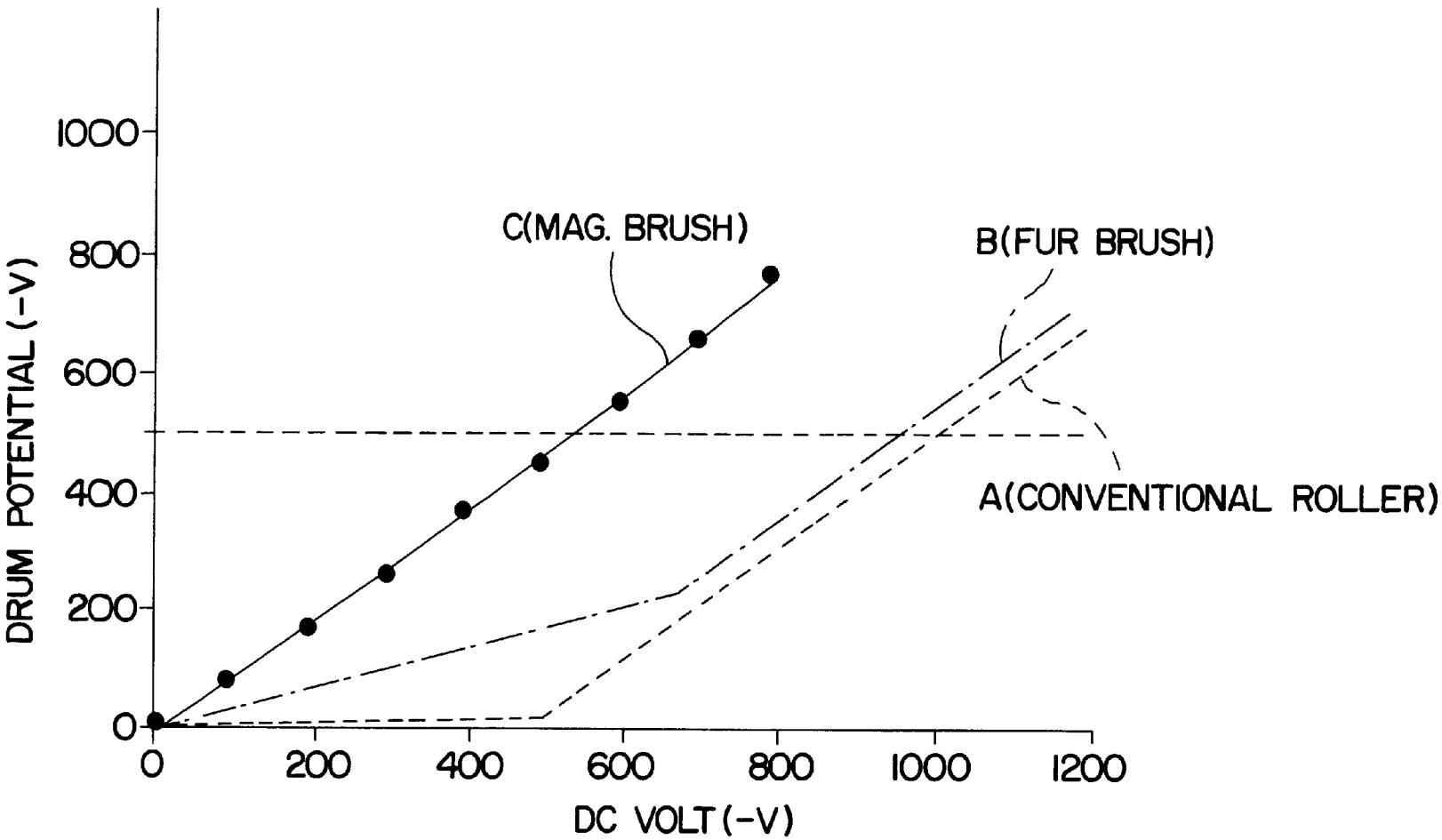
FIG. 4 is a graph of a charging property.

Referential FIG. 4 designates a transfer roller as a contact type transferring means. It has an electrical resistance in the medium range, and is placed in contact with the photosensitive drum 1, with a predetermined contact pressure, forming a transfer nip c. To this transfer nip c, a sheet of transfer medium P, as an image receiving medium, is delivered with a predetermined timing from an unillustrated sheet feeding station, and as the transfer medium P is passed through the nip c, a predetermined transfer bias voltage is applied to the transfer roller 4 from a transfer bias power source S3. As a result, the image formed of developer on the photosensitive drum 1 is progressively transferred onto the surface of the transfer medium P being fed into the transfer nip c.

The transfer roller 4 used in this embodiment comprises a metallic core 41, and a foamed layer 42 formed around the metallic core. The electrical resistance of the transfer roller 4 is $5\times10^8\Omega$, or a medium resistance. The image formed of developer is transferred by applying a DC voltage of +3000 V to the metallic core 41. The transfer medium P delivered to the transfer nip c is pinched between the transfer roller 4 and the photosensitive drum 1, and conveyed through the transfer nip c. As the transfer medium P is conveyed through the transfer nip c, the image formed of developer, on the peripheral surface of the photosensitive drum 1, is progressively transferred onto the front side of the transfer medium P by the electrostatic force and pressure.

Fixing Process

Referential FIG. 5 designates a thermal fixing apparatus. After being fed into the transfer nip c, and receiving the image formed of developer, on the photosensitive drum 1, the transfer medium P is separated from the peripheral surface of the photosensitive drum 1, and is introduced into the fixing apparatus 5. In the fixing apparatus 5, the image formed of developer is fixed to the transfer medium P. Thereafter, the transfer medium P is discharged as a print or a copy, from the apparatus.

Cartridge

The printer used in this embodiment uses a cartridge C, which is removably installable in the printer, and comprises a cartridge case, the photosensitive drum 1, and three processing devices: the charging roller 2, a charge facilitator particle coating apparatus 7, and the developing apparatus 3. These components are integrally placed in the cartridge case. It should be noted here that the total number of the components, and the component combination, are not limited to those of the cartridge C. It is desirable, however, that the cartridge comprises at least the charging roller 2 in addition to the photosensitive drum 1.

(2) Charge roller 2

The charge roller 2 used in this embodiment is a contact type elastic charging member. It is made by forming a layer of rubber, or foamed material, with medium electrical resistance, on the peripheral surface of the metallic core 21.

The material for the medium resistance layer 22 is composed of resin (for example, urethane), electrically conductive particulate substance (for example, carbon black), sulfurizing agent, foaming agent, and the like. In the case of the charging roller 2 in this embodiment, nylon was dispersed in the material (elastic resin) for the medium resistance layer, so that when the charging roller 2 and the photosensitive drum 1 are directly (without the presence of charging process facilitating particles between them) in contact with each other, the photosensitive drum 1 is triboelectrically charged to the same polarity as the polarity (negative in this embodiment) of the voltage applied to the charging roller 2 to charge the photosensitive drum 1. The thus formulated material is coated on the peripheral surface of the metallic core 21, forming a roller Then, the surface of the coated material is polished. In contrasts the surface layer of the photosensitive drum 1 is mainly composed of polycarbonate resin.

It is very important that the charging roller 2, that is, a contact type charging member, function as an electrode. In other words, not only should the charging roller 2 have enough elasticity to remain perfectly in contact with an object to be charged, but it also needs to have a low enough electrical resistance to be able to sufficiently charge a moving object. In addition, the charging roller 2 must be able to prevent such voltage leak that occurs if a pin hole or the like, that is, a defective spot in terms of voltage resistance, is present in the object to be charged. When the object to be charged is an electrophotographic photosensitive member, the electrical resistance of the charging roller 2 is desired to be in a range of $10^4$–$10^7\Omega$ in order to sufficiently charge the object while preventing voltage leak.

Further, the peripheral surface of the charging roller 2 is desired to be rough in microscopic terms as the surface of the foamed material, so that the charging roller 2 can hold the charging process facilitating particles m.

It is desirable that the hardness of the charging roller 2 be in a range of 25 degrees to 50 degrees on ASCAR C scale, because if the hardness is too low, the shape of the charging roller 2 becomes unstable, deteriorating the state of contact between the charging roller 2 and the object to be charged, whereas if the hardness is too high, not only is the formation of the charging nip a not guaranteed between the charging roller 2 and the object to be charged, but also the state of contact, in microscopic terns, between the charging roller 2 and the object to be charged becomes poor.

The elastic material for the charging roller 2 is not limited to the elastic foamed material. Such materials as EPDM, urethane, NBR, silicone rubber, IR, and the like, in which electrically conductive material such as carbon black or metallic oxide is dispersed to adjust electrical resistance, can be listed. Further, instead of dispersing electrically conductive material into the elastic material, ion conductive material may be used to adjust the electrical conductivity of the elastic material.

The charging roller 2 is placed in contact with the peripheral surface of the photosensitive drum 1, with a predetermined amount of contact pressure, so that the elasticity of the charging roller 2 allows the charging nip a to be formed between the two components. In this embodiment, the width of the charging nip a is several millimeters.

In this embodiment, the efficiency with which the photosensitive drum 1 is charged by the friction between the charging roller 2 and the photosensitive drum 1 is measured using the following method. First, the developing apparatus 3, the transfer roller, and the like, are moved away from the photosensitive drum 1, and only the charging roller 2 is left in contact with the photosensitive drum 1. Then, the photosensitive drum 1 is rotated, causing the charging roller 2 to follow the rotation of the photosensitive drum 1, while applying a voltage of 0 V to the charging roller 2. After the photosensitive drum 1 is rotated for one minute, the electrical potential level of the photosensitive drum 1 is measured. The triboelectrical charging efficiency of various charge rollers given below were obtained at 25° C., and at 30% humidity.

The electrical resistance and the triboelectrical charging efficiency (offset potential (V); electrical potential level to which the photosensitive drum 1 is charged by the friction between the charging roller 2 and the photosensitive drum 1) were measured, and the results are given in Table 1.

The electrical resistance of the charge roller was measured in the following manner: the photosensitive drum 1 of a printer was exchanged for an aluminum drum. Then, a voltage of 100 V was applied between the aluminum drum and the metallic core 21 of the charging roller 2, and the amount of current which flowed between the aluminum drum and the metallic core 21 of the charging roller 2 was measured.

For comparison, the electrical resistance of charge rollers B and C, described below, were also measured, along with their triboelectrical charging efficiency (offset potential (V)).

Charge roller B: substantially the same as the charge roller A, except that its medium electrical resistance layer (elastic resin laser) does not contain nylon.

Charge roller B: substantially the same as the charge roller A, except that the medium electrical resistance layer (elastic resin layer) contains Teflon (polytetrafluoroethylene resin) by 2% in weight, in place of nylon.

TABLE 1

| Charge roller | A | B | C |
|---|---|---|---|
| Electrical resistance | $5 \times 10^6$ | $5 \times 10^6$ | $5 \times 10^6$ |
| Offset potential (V) | −30 | 0 | +30 |

(3) Charging process facilitating particle m

In this embodiment, electrically conductive zinc oxide particles, which have a specific resistance of $10^7$ Ω.cm and an average particle size of 2.5 μm, are used as the charging process facilitator particles m to be coated on the peripheral surface of the charging roller 2.

The charging process facilitating particles m may be in the primary state, or in the secondary state, that is, in the aggregated state. Neither state causes any problem; no matter what state of aggregation the charging process facilitating particles m are in, the state of the charging process facilitating particles m is not important as long as the charging process facilitating particles m can facilitate the charging process.

When the particles are in the aggregated state, the average size of the aggregates was used for the average size of the charging process facilitating particles m. As for the method for measuring the particle size, no less than 100 pieces of charging process facilitating particles m are picked using an optical or electron microscope, and the distribution of their volumetric size was calculated using their maximum horizontal chord length. Then, the 50% average of their volumetric size calculated from the thus obtained distribution was used as the average size of the charging process facilitating particles m.

When the electrical resistance of the charging process facilitating particle m was no less than $10^{12}$ Ω.cm, the charging efficiency of the charging roller 2 was poor. Thus, the electrical resistance of the charging process facilitating particle m is desired to be no more than $10^{12}$ Ω.cm, preferably, no more than $10^{10}$ Ω.cm. In this embodiment, the charging process facilitator particle m with an electrical resistance of $1\times10^7$ Ω.cm was used. The electrical resistance of the charging process facilitating particle m was measured using a tablet method, and the obtained resistance values were normalized. More specifically, approximately 0.5 gram of the charging process facilitating particles m in the powder state was placed in a cylinder with a bottom diameter of 2.26 $cm^2$, and the electrical resistance between the top and bottom electrode was measured while applying a voltage of 100 V between the top and bottom electrodes, and also while applying a pressure of 15 kg to the charging process facilitating particles m through the top and bottom electrodes. Then, the obtained resistance values were normalized to obtain the specific resistivity of the charging process facilitating particle m.

The charging process facilitating particle m are desired to be white or transparent, and also nonmagnetic, so that they do not interfere with the exposing process for forming a latent image. Further, in consideration of the fact that some of the charging process facilitating particles m are transferred onto the transfer medium P, the charging process facilitating particles m to be used in color image recording are desired to be colorless or white. Further, the charging process facilitating particles m sometimes interfered with the exposing process unless their size was no more than ½ of the particle size of the developer 31. Thus, it is desirable that the size of the charging process facilitating particle m be smaller than the ½ of the particle size of the developer 31. The smallest size which allows the charging process facilitating particle to remain in a stable state seems to be 10 nm.

In this embodiment, zinc oxide is used as the material for the charging process facilitating particle m. However, the material for the charging process facilitating particle m does not need to be limited to the material used in this embodiment. In other words, various materials other than zinc oxide are usable as the material for the charging process facilitating particle m; for example, a particle formed of electrically conductive nonorganic metallic oxide such as alumina, a particle formed of mixture of organic and nonorganic materials, and the like. Further, the charging process facilitating particles m may be given surface treatment.

(4) Charge injecting process

<1> When the photosensitive drum 1, as the image bearing member, and the charging roller 2, as the contact type charging member, are placed directly in contact with each other, the frictional resistance between them makes it difficult to rotate them while maintaining peripheral velocity difference between them. However, when the charging process facilitating particles m are placed between the charging roller 2 and the photosensitive drum 1, in the charging nip a, the charging process facilitating particles m provide lubricative effects, and therefore, the charging roller 2 and photosensitive drum 1 can be easily rotated in contact with each other while maintaining the peripheral velocity difference between the two. The presence of the charging process facilitating particles m between the charging roller 2 and photosensitive drum 1 renders the state of contact between the two more desirable, causing the peripheral surface of the charging roller 2 to make contact with the peripheral surface of the photosensitive drum 1 at a higher frequency.

Providing a sufficient amount of velocity difference between the charging roller 2 and the photosensitive drum 1 drastically increases the frequency at which the charging process facilitating particles m contacts the photosensitive drum 1 in the charging nip a between the charging roller 2 and the photosensitive drum 1, thus improving the state of contact between the charging roller 2 and the photosensitive drum 1 by filling the microscopic voids present in the charging nip a between the charging roller 2 and photosensitive drum 1. In other words, the provision of a sufficient amount of velocity difference between the charging roller 2 and the photosensitive drum 1 causes the charging process facilitating particles m present in the charging nip a between the charging roller 2 and the photosensitive drum 1 to rub the peripheral surface of the photosensitive drum 1, leaving virtually no gap between the two peripheral surfaces, and therefore, causing electrical charge to be directly injected into the photosensitive drum 1; the presence of the charging process facilitating particles m between the charging roller 2 and photosensitive drum 1 causes the photosensitive drum 1 to be charged mainly through charge injection. As a result, the photosensitive drum 1 is charged in a manner characterized by a line C in FIG. 4.

As for the structure for providing the aforementioned peripheral velocity difference, the charging roller 2 is rotatively driven, independently from the photosensitive member 1. Preferably, the rotational direction of the charging roller 2 is such that in the charging nip a, the peripheral surface of the charging roller 2 moves in the direction opposite to the moving direction of the photosensitive member 1, so that the developer, which is remaining on the photosensitive member 1 after image transfer, and is being carried to the charging nip a, can be temporarily recovered by the charging roller 2. In other words, electrical charge can be more efficiently injected by temporarily separating the above described residual developer on the photosensitive member 1 from the photosensitive member 1 by moving the peripheral surface of the charging roller 2 in the direction opposite to the rotational direction of the photosensitive member 1. It is possible to provide a predetermined amount of peripheral velocity difference between the charging roller 2 and the photosensitive member 1 while moving the peripheral surfaces of the charging roller 2 and the photosensitive member 1 in the same direction in the charging nip a. But, in such a case, in order to provide the same peripheral velocity difference as that provided by moving the peripheral surfaces of the charging roller 2 and photosensitive member 1 in the directions different from each other, the peripheral velocity of the charging roller 2 must be drastically increased, and therefore, the moving of the peripheral surfaces of the charging roller 2 and photosensitive member 1 in the counter directions in the charging nip a is advantageous.

Therefore, the charging method in this embodiment can attain the high charging efficiency which is impossible to attain with the use of a conventional roller based method; the photosensitive member 1 can be charged to approximately the same potential level as the level of the voltage applied to the charging roller 2. In other words, according to this embodiment of the present invention, even when the charging roller 2 is used as the contact type charging member, the voltage level of the bias to be applied to the charging roller 2 to charge the photosensitive member 1 to a predetermined potential level may be equivalent to the predetermined potential level to which the photosensitive member 1 needs to be charged, and therefore, a contact type charging system and a contact type charging apparatus, which do not use electrical discharge, and therefore, are stable and safe, can be realized.

As for the amount of the charging process facilitating particles m to be kept between the photosensitive member 1 as the image bearing member and the charging roller 2 as the contact type charging member, in the charging nip a, if the amount is too small, the lubricative effect of the charging process facilitating particles m does not reach a satisfactory level. Therefore, the friction between the charging roller 2 and the photosensitive member 1 remains too large, making it difficult for the charging roller 2 to be rotatively driven while maintaining a predetermined peripheral velocity difference relative to the photosensitive member 1. In other words, the torque necessary to drive the charging roller 2 while maintaining the predetermined peripheral velocity difference becomes too large, and if the charging roller 2 is forced to rotate, the peripheral surfaces of the charging roller 2 and the photosensitive member 1 are shaved. In addition, the frequency with which the charging roller 2 and the photosensitive member 1 are electrically connected by the charging process facilitating particles m is not increased enough to provide satisfactory charging efficiency. On the other hand, if the amount of the charging process facilitating particles m kept between the photosensitive member 1 and the charging roller 2 is too large, the amount of charging process facilitating particles m which fall from the charging roller 2 becomes excessive, derogatorily affecting the image forming processes.

According to an experiment, the desirable amount of the charging process facilitating particles m between the charging roller 2 and the photosensitive member 1 was no less than $10^3$ particle/mm$^2$. If the amount is less than $10^3$ particle/mm$^2$, the charging process facilitating particles m could not be sufficiently lubricative, and also could not establish electrical connection between the charging roller 2 and the photosensitive member 1 with satisfactory frequency, failing to drastically improve the charging efficiency.

Preferably, the amount of the charging process facilitating particles m kept between the charging roller 2 and the photosensitive member 1 is in a range of $10^3$–$5\times10^5$ particle/mm$^2$. If the number exceeds $5\times10^5$ particle/mm$^2$, the amount of the charging process facilitating particles m which fall onto the photosensitive member 1 drastically increases, causing the photosensitive member 1 to be insufficiently exposed regardless of the degree of the transparency of the charging process facilitating particles m themselves. If the number is below $5\times10^5$ particles/cm$^2$, the amount of the particles which fall onto the photosensitive member 1 is relatively small, and therefore, the derogatory effects of the charging process facilitating particles m are also small. The amount of the charging process facilitating particles m which fell onto the photosensitive member 1 while the amount of the charging process facilitating particles m between the charging roller 2 and the photosensitive member 1 was kept in the preferable range was in a range of $10^2$–10 particle/cm$^2$. Therefore, in order to prevent the charging process facilitating particles m from interfering with the image forming processes, the amount of the charging process facilitating particles m kept between the charging roller 2 and the photosensitive member 1 is desired to be no more than $10^5$ particle/cm$^2$.

Next, a method for measuring the amount of the charging process facilitating particles m between the charging roller 2 and the photosensitive member 1, and the amount of the charging process facilitating particles m on the photosensitive member 1, will be described. The amount of the charging process facilitating particles m in the charging nip a is desired to be directly measured. However, the direct method is difficult because the majority of the particles present on the photosensitive member 1 before they come in contact with the charging roller 2 are scraped away by the charging roller 2, the peripheral surface of which is moving in the direction opposite to the moving direction of the photosensitive member 1, in the charging nip a. Therefore, in this embodiment, the amount of the charging process facilitating particles m between the charging roller 2 and the photosensitive member 1, in the charging nip a, is defined as the amount of the charging process facilitating particles m on a given point of the charging roller 2 just before the point enters the charging nip a. More specifically, the rotation of the photosensitive member 1 and the charging roller 2 is stopped while the charge bias is not applied, and the peripheral surfaces of the photosensitive member 1 and the charging roller 2 are photographed with a video-microscope (OVM1000N: product of Olympus Optical Co., Ltd.) and a digital still recorder (SR-3100: product of Deltis Co.). In the case of the charging roller 2, the charging roller 2 is pressed against a slide glass in the same manner as the charging roller 2 is pressed against the photosensitive member 1, and ten or more locations within the area of contact between the charging roller 2 and the slide glass are photographed with the video-microscope fitted with an object lens with a magnification of 1000 times, from the back side of the slide glass. Then, each of the obtained digital images is converted into binary codes using a predetermined threshold value to segment the image into the regions with, and without, a charging process facilitating particle, and the number of the regions with a particle is calculated using a predetermined software. The amount of the charging process facilitating particles m on the photosensitive member 1 is obtained in the same manner; the peripheral surface of the photosensitive member 1 is photographed with a similar video-microscope, and the obtained images are processed in the same manner.

<2> In the case of a cleanerless image forming apparatus, the developer, which is remaining on the peripheral surface of the photosensitive member 1 after image transfer, is carried straight to the charging nip a between the photosensitive member 1 and the charging roller 2 by the movement of the peripheral surface of the photosensitive member 1.

In the charging nip a, the pattern, which has been formed by the transfer-residual developer on the photosensitive member 1, is disturbed, or erased by the charging roller 2 placed in contact with the photosensitive member 1 while maintaining a peripheral surface velocity difference between the charging roller 2 and the photosensitive member 1. As a result, the pattern, which generally reflects the image formed in the preceding image formation cycle, is prevented from appearing as a ghost in the half-tone regions of a currently formed image.

<3> After being carried to the charging nip a, the transfer-residual developer adheres to the charging roller 2. Generally, the adhesion of the transfer-residual developer to the charging roller 2 causes the photosensitive member 1 to be insufficiently charged because the developer is an insulator in normal cases.

However, in the case of this embodiment, the presence of the charging process facilitating particles m in the charging nip a between the photosensitive member 1 and the charging roller 2 keep the charging roller 2 and photosensitive member 1 in better contact with each other, electrically and physically. Therefore, electrical charge can be injected into the photosensitive member 1 in spite of the contamination of the charging roller 2 by the transfer-residual developer. In other words, the photosensitive member 1 can be uniformly charged by applying relatively low voltage; the photosensitive member 1 can be charged while generating virtually no ozone; and the charging efficiency does not decline for a long time.

<4> The transfer-residual developer which has adhered to the charging roller 2 gradually dislodges from the charging roller 2 and transfers onto the photosensitive member 1, and moves to the development station b as the peripheral surface of the photosensitive member 1 moves. Then, it is removed (recovered for toner recycling) from the photosensitive member 1 by the developing apparatus 3 at the same time as the latent image is developed by the developing apparatus.

Since, in this embodiment, the charging process facilitating particles m are borne on charging roller 2, the adhesiveness of the transfer-residual developer to the charging roller 2 is reduced, improving the efficiency with which the transfer-residual developer is transferred onto the photosensitive member 1.

In a cleaning process, which concurrently occurs with a developing process, in the same location, developer is recovered by the potential difference established for fog prevention, that is, the difference Vback in voltage between the DC bias applied in the developing apparatus, and the surface potential of the photosensitive member 1. In other words, the toner which is remaining on the photosensitive member 1 after image transfer is recovered during the developing process of the immediately following image forming cycle, in which the same photosensitive member 1 is charged; the charged photosensitive member 1 is exposed to form a latent image; and the latent image is developed. In the case of such a printer as the printer in this embodiment, which uses a reversal development process, the aforementioned cleaning process concurrent with a development process is carried out by an electrical field which transfers toner from the photosensitive member 1 regions with dark portion potential level to a development sleeve, and an electrical field which adheres toner from the development sleeve to the photosensitive member 1 regions with the light portion potential level.

<5> The presence of such charging process facilitating particles m, which are being held on the peripheral surface of the photosensitive member 1 after having been adhered thereto, is effective to improve the efficiency with which the developer is transferred from the photosensitive member 1 side to the transfer medium P side.

Preservation of Charging Efficiency During Shortage of Charging Process Facilitating Particles m Even if a sufficient amount of charging process facilitating particles m has been placed in the charging nip a between the photosensitive member 1 and the charging roller 2, or has been coated on the charging roller 2, the charging process facilitating particles m are gradually lost from the charging nip a or charging roller 2 while an apparatus is operated. This is true even if an image forming apparatus is provided with a charging process facilitating particle coating apparatus 7 as it is in this embodiment; for example, when the charging process facilitating particles m in the container 71 have been completely consumed, or the coating apparatus 7 malfunctions, the amount of the charging process facilitating particles m in the charging nip a or on the charging roller 2 decreases.

The decrease of the charging process facilitating particles m in the charging nip a or on charging roller 2 reduces charge injection efficiency. This is due to the fact that the decrease of the charging process facilitating particles m in the charging nip a between the charging roller 2 and photosensitive member 1 deteriorates the state of contact between the two components, and therefore, the regions of the photosensitive member 1, correspondent to where the supply of the charging process facilitating particles m is short, is charged to a potential level lower than the surroundings regions.

As described before, in this embodiment, an arrangement is made so that if the photosensitive member 1 directly comes in contact with the charging roller 2, that is, the photosensitive member 1 comes in contact with the charging roller 2 without the presence of the charging process facilitating particles m between the two, the photosensitive member 1 is triboelectrically charged to the same polarity (negative in this embodiment) as the polarity of the voltage applied to the charging roller 2. With the provision of this arrangement, the potential level to which the photosensitive member 1 is ultimately charged does not drop much even if the amount of the charging process facilitating particles m in the charging nip a or on the peripheral surface of the charging roller 2 temporarily decreases, and causes the efficiency with which charge is injected into the photosensitive member 1 to temporarily drop, since the temporary drop in charge injection efficiency is compensated for by the increase in the efficiency with which the photosensitive member 1 is triboelectrically charged to the same polarity as the polarity of the charge injected to the photosensitive member 1 by the charging roller 2. Thus, in this embodiment, the apparent charging efficiency, or the combined charging efficiency, can be maintained at a desirable level.

More specifically, when the charging roller 2 comes directly in contact with the photosensitive member 1, the photosensitive member 1 is triboelectrically charged by the friction between the charging roller 2 and the photosensitive member 1, and the potential level of the photosensitive member surface rises in the direction of the polarity (negative direction) to which the photosensitive member 1 is to be charged. Therefore, even if points at which the contact between the charge roller 2 and the photosensitive member is poor, that is, points at which charge injection efficiency is poor, are present adjacent to the point at which the charging roller 2 and the photosensitive member 1 make direct contact with each other, the apparent charge injection efficiency is not likely to drop.

(6) Change in amount of charging process facilitating particles adhering to peripheral surface of charging roller, and change in charging efficiency <1> For the purpose of studying the change in charging efficiency which occurs when the amount of the charging process facilitating particles m adhering to the peripheral surface of the charging roller 2 changes, several tests were conducted, in which the amount of the charging process facilitating particles m on the peripheral surface of the charging roller 2 was set at four different levels (amounts 1–4) as shown Table 2, and the change in the charging efficiency was measured.

As for the scale used for measuring the amount of the charging process facilitating particles m adhering to the peripheral surface of the charging roller 2, the area ratio was used, which indicates how much area of the peripheral surface of the charging roller 2 is covered with the charging process facilitating particles m.

TABLE 2

| Amount | 1 | 2 | 3 | 4 |
|---|---|---|---|---|
| Ratio (%) | 95 | 85 | 75 | 60 |

<2> The charging roller 2 was placed in contact with the photosensitive member 1 in a predetermined manner, and the amount of the charging process facilitating particles m adhered to the peripheral surface of the charging roller 2 was varied as shown in Table 2. Then, the surface potential (offset potential) of the photosensitive member 1 was measured after the photosensitive member 1 rotated once while applying a voltage of 0 V to the charging roller 2 which was being rotated at a peripheral velocity equal to 100% of the peripheral velocity of the photosensitive member 1, in such a direction that the moving direction of the peripheral surface of the charging roller 2, in the charging nip a, became opposite (counter) to the moving direction of the peripheral surface of the photosensitive member 1.

The tests were conducted using charging roller A, which was the roller in accordance with this embodiment, and charging rollers B and C, which were comparative rollers. The results of the first test are given in Table 3.

TABLE 3

| Roller type | A | B | C |
|---|---|---|---|
| Amount of adhesion 1 | −5 | 0 | +5 |
| Amount of adhesion 2 | −15 | 0 | +15 |
| Amount of adhesion 3 | −25 | 0 | +25 |
| Amount of adhesion 4 | −40 | 0 | +40 |

In this test, the offset potential immediately after a single rotation of the photosensitive member 1 decreased, regardless of the type (A, B, or C) of charging roller, as the amount of the charging process facilitating particles m adhering to the charging roller 2 increased (4→1). This is because the contact area between the peripheral surfaces of the charging roller 2 and the photosensitive member 1, in the charging nip a, decreased as the amount of the charging process facilitating particles m adhering to the charging roller 2 increased.

Further, a charge roller A, which was the charge roller in accordance with this embodiment, charged (triboelectrically) the photosensitive member 1 to the polarity (negative) which was the same as the polarity of the voltage applied to a charge roller A.

The charge roller B failed to charge the photosensitive member 1, and the charge roller C charged the photosensitive member 1 to the polarity (positive) opposite to the polarity of the voltage applied to the charge roller C.

<3> In the second test, the surface potential level (V) of the photosensitive member 1 was measured after a single rotation while charging a voltage of −700 V to the charging rollers under the conditions defined in <2>. The results are given in Table 4.

TABLE 4

| Roller type | A | B | C |
|---|---|---|---|
| Amount of adhesion 1 | −685 | −680 | −675 |
| Amount of adhesion 2 | −685 | −670 | −655 |
| Amount of adhesion 3 | −680 | −655 | −650 |
| Amount of adhesion 4 | −675 | −635 | −595 |

<4> In the third test, the surface potential level (V) of the photosensitive member 1 was measure after a single rotation, and also after ten rotations, of the photosensitive member 1, under the same conditions as the conditions in <3>. The results are given in Table 5, in which the first figures represent the potential level (V) to which the surface potential of the photosensitive member 1 converged after ten rotations, and the second figures represent the percentage of the potential level of the photosensitive member 1 after a single rotation, relative to the potential level of the photosensitive member 1 after ten rotations.

TABLE 5

| Roller type | A | B | C |
|---|---|---|---|
| Amount of adhesion 1 | −705/97 | −700/97 | −695/97 |
| Amount of adhesion 2 | −715/96 | −700/96 | −685/96 |
| Amount of adhesion 3 | −725/94 | −700/94 | −675/96 |
| Amount of adhesion 4 | −740/91 | −700/91 | −660/90 |

Table 5 shows that the level to which the surface potential of photosensitive member 1 converged exceeded the voltage level (−700 V) of the bias applied to the charging roller. This occurred because the photosensitive member 1 was additionally charged by the friction between the photosensitive member 1 and charging roller A.

As is evident from Table 4 and Table 5, generally speaking, the ratio of the surface potential level of the photosensitive member 1 after a first rotation of the photosensitive member 1, relative to the surface potential level of the photosensitive member 1 after tenth rotation of the photosensitive member 1, drops, because, as the amount of the charging process facilitating particles adhering to the charge roller becomes smaller (amount 1→4), the charging efficiency falls.

However, in the case of a charging roller, such as charging roller A in accordance with this embodiment, the directions in which the charging efficiency of the charging roller changes as the amount of the charging process facilitating particles changes, and the direction in which the offset potential level changes as the amount of the charging process facilitating particles changes, are opposite. Therefore, the apparent surface potential level of the photosensitive member 1, that is, the combination of the surface potential level by the charging roller, and the offset potential level, quickly reaches the level equal to the level of the voltage applied to the charging roller, regardless of the amount of the charge process facilitating particles adhering to the charging roller.

On the contrary, in the case of a charging roller, such as charging roller C, the direction in which the charging efficiency of the charging roller changes as the amount of the charging process facilitating particles changes, and the direction in which the offset potential level changes as the amount of the charging process facilitating particles changes, are the same. Therefore, the apparent surface potential level of the photosensitive member 1 after the first rotation of the photosensitive member 1 greatly changes as the amount of the charging process facilitating particles on the charging roller decreases.

Also regarding the surface potential level of the photosensitive member 1 after the first rotation of the photosensitive member 1, the table shows that in the case of charging roller B or C, that is, the comparative charging rollers, the surface potential level of the photosensitive member 1 after the first rotation of the photosensitive member 1 greatly changed as the amount of the charging process facilitating particles adhering to charging roller B or C decreased. Further, the change in the surface potential level of the photosensitive member 1, which was caused by the decrease in the amount of the charging process facilitating particles adhering to charging roller B or C, finally vanish after ten rotations of the photosensitive member 1; it took a long time to compensate for the surface potential level change.

In contrast, when the charging roller A, which was the charging roller in accordance with this embodiment, was used, the surface potential level of the photosensitive member 1 after the first rotation hardly changed in spite of the change in the amount of the charging process facilitating particles on the peripheral surface of charging roller A. In other words, the apparent charging efficiency remained stable, making it possible to produce high quality images.

Embodiment 2 (FIG. 2)

FIG. 2 is a schematic section of the image forming apparatus in the second embodiment of the present invention, and depicts the general structure of the apparatus.

The image forming apparatus in this embodiment is also a laser printer, like the printer in the first embodiment (FIG. 1), which uses a transfer type electrophotographic process, a contact type charging system, a reversal type development process, a cleanerless cleaning system, and a process cartridge.

This embodiment is characterized in that the electrical charge is injected into a photosensitive member 1 as the image bearing member, by placing electrically conductive charging process facilitating particles at least in the charging nip a between a charging roller 2, which is of a contact type charging member, and the photosensitive member 1, and also that when the charging roller 2 and the photosensitive member 1 are placed in contact with each other without the presence of the charging process facilitating particles between them, the photosensitive member 1 is triboelectrically charged to the same polarity as the polarity of the voltage applied to charge the image bearing member.

The printer in this embodiment is different from the printer in the first embodiment in that the apparatus for coating charging process facilitating particle onto the charging roller 2 is eliminated. Thus, instead of directly coating the charging process facilitating particles m onto the charging roller 2, the charging process facilitating particles m are added to the developer 3 in the developing apparatus 3 in advance. Then, in the development station b, the charging process facilitating particles m are adhered to the peripheral surface of the photosensitive member 1 by the developing apparatus 3 which charges the particles m to the polarity opposite to the polarity to which the photosensitive member 1 is charged. Thereafter, the charging process facilitating particles m, which are adhering to the photosensitive member 1, are carried to the charging nip a, past the transfer station c, by the movement of the peripheral surface of the photosensitive member 1. In other words, the charging process facilitating particles m are automatically delivered to the charging nip a and the peripheral surface of the charging roller 2 by being added to the developer 31 in the developing apparatus 3, so that charging efficiency can be maintained at the optimum level. It is desirable that the charging roller 2 be initially coated with the charging process facilitating particles m.

The other features of the printer in this embodiment are the same as those of the printer in the first embodiment. Therefore, their description will not be repeated here.

The charging process facilitating particles m in this embodiment are the same as those in the first embodiment; in other words, they are also electrically conductive zinc oxide particles, and are $10^7$ Ω.cm in specific resistivity, and 2.5 μm in average particle size. These charging process facilitating particles m are added to the developer in the developing apparatus 3 at a ratio of 2 parts in weight of the charging process facilitating particles m to 100 parts in weight of the developer. Generally, the number of parts in weight of the charging process facilitating particles m added to 100 parts in weight of the developer is in a range of 0.01–20. The charging process facilitating particles m added to the developer 31 are charged by the friction between the charging process facilitating particles m and the developer 31, to the polarity opposite to the polarity (positive in this embodiment) to which the developer 31 is charged, that is, the polarity opposite to the polarity to which the photosensitive member 1 is charged.

Then, while an electrostatic latent image on the peripheral surface of the photosensitive member 1 is developed in reverse by the developing apparatus 3, that is, while the developer 31 adheres to (develops) the exposed portions, or the portions correspondent to the dark portions of the image, the charging process facilitating particles m with the polarity opposite to the polarity of the developer 31 adhere to the unexposed portions, or the portions correspondent to white portions of the image. This is due to the following reason. Most of the time, a printer prints character images, in which image area takes up only several percents of the entire printable area of a sheet of transfer medium. Therefore, from the standpoint of preventing the charging nip a from becoming short of the charging process facilitating particles m, adhering the charging process facilitating particles m to the white portion is better than adhering the charging process facilitating particles m to the dark portion. Further, in order to ensure that the charging process facilitating particles n are supplied to even the longitudinal edge portions of the charging roller 2, the charging process facilitating particles m should be adhered to the white portions, because, in many cases, the characters are not printed on the edge portions of a recording medium, that is, the portions correspondent to the longitudinal edge portions of the charging roller 2. As is evident from the above description, the charging process facilitating particles m are desired to be charged in the developing apparatus 3, to the polarity opposite to the polarity to which toner is charged.

In the transfer station b, an image formed of developer on the photosensitive member 1 aggressively transfers onto the transfer medium P as it is attracted toward the transfer medium P by the effect of the transfer bias. However, the charging process facilitating particles m on the photosensitive member 1 do not aggressively transfer onto the transfer medium P because the charging process facilitating particles m are electrically conductive. Thus, the charging process facilitating particles m having been adhered onto the photosensitive member 1 basically remain on the photosensitive member 1, and are carried to the charging nip a, past the transfer station b, by the movement of the peripheral surface of the photosensitive member 1, replenishing the charging nip a and the peripheral surface of the charging roller 2 with the charging process facilitating particles m.

The charging roller 2 in this embodiment is also capable of triboelectrically charging the photosensitive member 1 to a certain potential level (offset potential) as the charge roller (charge roller A) in the first embodiment is. Therefore, the direct contact between the peripheral surfaces of the charging roller 2 and the photosensitive member 1 triboelectrically charges the photosensitive member 1, and as a result, the surface potential level of the photosensitive member 1 increases in the same direction as the direction in which the photosensitive member 1 is charged by the bias applied to the charging roller 2. As described above, the charging process facilitating particles m used in this embodiment are characterized in that while they are in the developing apparatus 3, the polarity of their potential is opposite to the polarity of the surface potential of the photosensitive member 1. Therefore, as the surface potential level of the photosensitive member 1 increases in the same polarity direction as the polarity direction in which the photosensitive member 1 is charged by the charging roller 2, the amount of the charging process facilitating particles m transferred onto the photosensitive member 1 from the developing apparatus 3 increases. In other words, as the amount of the charging process facilitating particles m in the charging nip a or on the peripheral surface of the charging roller 2 decreases, the amount of the charging process facilitating particles m supplied from the developing apparatus 3 increases.

Table 6 shows the amount of the charging process facilitating particles m which were adhered to the peripheral surface of the charging roller 2, and the amount of the charging process facilitating particles m which were transferred onto the photosensitive member 1, in one of the tests. In this test, the developing apparatus 3 was removed. The table shows the surface potential level of the photosensitive member 1 measured at the development station b after 10 solid white images were printed. Further, an elastic blade was disposed on the downstream side of the charging roller 2 to ensure that no developer 31 or the charging process facilitating particle m was present on the peripheral surface of the photosensitive member 1 when the surface potential level of the photosensitive member 1 was measured. The amount of the charging process facilitating particles m which were transferred onto the photosensitive member 1 was evaluated by counting the number of the charging process facilitating particles m in an enlarged photograph of the peripheral surface of the photosensitive member 1.

TABLE 6

| Amount of adhesion | 1 | 2 | 3 | 4 |
|---|---|---|---|---|
| Surface potential level (V) of photosensitive member after being charged | −695 | −705 | −713 | −730 |
| Amount of charging process facilitating particles transferred onto photosensitive member (number/mm$^2$) | 4–50 | 6–80 | below 80 | above 80 |

In Table 6, the surface potential level (V) of the photosensitive member 1 after being charged is above the bias (−700 V) applied to the charging roller 2. This occurred because the photosensitive member 1 was triboelectrically charged by the friction between the photosensitive member 1 and the charging roller 2.

Thus, in this embodiment, as the amount of the charging process facilitating particles m in the charging nip a or on the peripheral surface of the charging roller 2 decrease, the amount of the charging process facilitating particles m supplied from the developing apparatus 3 increases. Therefore, the amount of the charging process facilitating particles m on the peripheral surface of the charging roller 2 is not likely to continuously decreases. Meanwhile, contrary to the amount of the charging process facilitating particles m, the amount of the developer 31 which transfers onto the photosensitive member 1 in the charging nip a decreases. Therefore, the developer 31 is not likely to deteriorate the charging efficiency of the charging roller 2 by adhering to the charging roller 2 by a large amount.

Because of the reason given above, in the case of the image forming apparatus in this embodiment, the efficiency with which the photosensitive member 1 is charged is not likely to deteriorate, and therefore, high quality images can be produced.

Miscellaneous

1) A charging roller does not need to be a contact type elastic charging member such as the charging roller 2 in this embodiment.

For example, a fur brush type charging device may be used in place of a contact type elastic charging member. As for the material for a charging member, felt or fabric may be used. Also, the configuration of a charging member may be different from the one described in this specification. Further, various materials may be coated in layer to provide proper elasticity and electrical conductivity.

2) When an object is electrically charged using a contact type charging method, in particular, when electrical charge is injected into an object, the state of contact between a contact type charging member and the object to be charged greatly affects the charging efficiency. Therefore, the surface density of a contact type charging member should be as high as possible. Further, a charging device should be structured in such a manner that the velocity difference between the surfaces of a charging member and an object to be charged becomes as high as possible, and also that the two surfaces make contact with each other as frequently as possible.

The surface resistance of an object to be charged may be adjusted by covering the object with a charge injection layer so that when the object is electrically charged by a contact type charging method, the direct injection process becomes dominant.

FIG. 3 is a schematic vertical section of the peripheral surface portion of the photosensitive member 1 provided with a charge injection layer 16, and depicts the laminar structure of the photosensitive member 1. This photosensitive member 1 is constructed by laminating an undercoat layer 12, a positive charge injection prevention layer 13, a charge generation layer 14, a charge transfer layer 14, and the charge injection layer 16, on the peripheral surface of an aluminum base (aluminum drum), in the stated order from the bottom. In other words, the photosensitive member 1 is constituted of an ordinary organic photosensitive member, and the charge injection layer 16 coated on the peripheral surface thereof, to improve the efficiency with which the ordinary photosensitive member is electrically charged.

The material for the charge injection layer 16 is formulated by dispersing ultramicroscopic particles 16*a* of $SnO_2$ (particles size of approximately 0.03 $\mu$m) as electrically conductive particles (electrically conductive filler), lubricative agent such as polytetrafluoroethylene (commercial name: Teflon), polymerization initiator, and the like, into photo-curable acrylic resin as binder. The charge injection layer 16 is formed by coating this material on the charge transfer layer 15, and curing the material into a film by a photo-curing method.

The most important property of the charge injection layer 16 is its surface electrical resistance. In the case of a direct injection charging system, charging efficiency can be improved by reducing the electrical resistance of an object to be charged. However, when the object to be charged is a photosensitive member, an electrostatic latent image must be preserved for a certain length of time. Therefore, the volumetric resistivity of the charge injection layer 16 should be in a range of $1\times10^{9}$–$1\times10^{14}$ Ω.cm.

It should be noted here that even if a photosensitive member is not provided with the charge injection layer 16 as the photosensitive members 1 in the first and second embodiments were, effects similar to the effects of the charge injection layer 16 can be provided as long as the resistance of the charge transfer layer 15 is within the aforementioned proper range for the charge injection layer 16.

Further, effects similar to the effects of the charge injection layer 16 can be also provided by employing a photosensitive member based on amorphous silicon or the like, the surface layer of which has a volumetric resistance of approximately $10^{13}$ Ω.cm.

3) When the voltage applied to a contact type charging member, a developing apparatus, or the like, comprises AC voltage (alternating voltage), the AC voltage component may be in the form of a sine wave, a rectangular wave, a triangular wave, or the like; it should be in the most appropriate form. Further, the voltage applied to a contact type charging member may be in the form of such a rectangular wave that is generated by periodically turning on and off a DC power source. In essence, the wave form of an alternating voltage to be applied to charge an object should be periodic; any such voltage that periodically changes its value may be used as the bias to be applied to charge an object.

4) An exposing means for forming an electrostatic latent image is not limited to a scanning laser beam type exposing means, such as the exposing means in the preceding embodiments, which digitally forms a latent image. It may be an ordinary analog exposing means, a light emitting element such as an LED, a combination of a light source such as a fluorescent light and a liquid crystal shutter, or the like means. In other words, it does not matter as long as an electrostatic latent image that accurately reflects image formation data can be formed.

The image bearing member 1 may be constituted of an electrostatically recording dielectric member, or the like. In this case, an electrostatic latent image is written on the dielectric member by selectively removing electrical charge from the surface of the dielectric member after uniformly charging the surface of the dielectric member to a predetermined polarity and potential level.

5) In the preceding embodiments, a developing means was described referring to the developing apparatus 3 in which a latent image was developed in reverse using nonmagnetic, nonconductive, single component developer. However, there is no specific restriction regarding the structure of a developing means. As a matter of fact, a developing means may be a means for normally developing a latent image.

6) The present invention is also applicable to an image forming apparatus which does not rely on image transfer, that is, such an image forming apparatus that uses a sheet of photosensitive paper or electrostatic recording paper, as recording medium, and forms an image directly on the recording medium by charging the surface of the recording medium through a contact type charging process.

Further, the present invention is applicable to a transfer type image forming apparatus comprising a cleaner or the like for removing the transfer-residual developer, paper dust, and the like from the image bearing member 1.

7) In the case of a transfer type image forming apparatus compatible with present invention, the recording medium which receives a developer image from the image bearing member 1 may be constituted of an intermediary transfer medium such as a transfer drum.

8) An example of a method for measuring the particle size of the developer (toner) 31 is as follows. As for a measuring apparatus, a Coulter counter TA-2 (Coulter Co.) is used. It is connected to an interface (Nikkaki, Co.) which outputs number average distribution and volume average distribution, and a personal computer CX-1 (Canon). Electrolyte is 1% water solvent of NaCl, formulated by dissolving first class sodium chloride into water.

Into 100–150 ml of the aforementioned electrolytic water solution, 0.1–5 ml of surfactant, preferably, alkyl benzene sodium sulfonate, is added. Then, 0.5–50 mg of sample is added.

The electrolyte in which the sample is suspended is processed for approximately 1–3 minutes with an ultrasonic dispersing device. Then, the size distribution of the particles which are 2–40 $\mu$m in size is measured using an aperture of 100$\mu$, and volume average distribution is calculated. The volume average particle size is obtained from the thus obtained volume average distribution.

While the invention has been described with reference to the structures disclosed herein, it is not confined to the details set forth, and this application is intended to cover such modifications or changes as may come within the purposes of the improvements or the scope of the following claims.

What is claimed is:

1. A charging apparatus for charging a member to be charged, said charging apparatus comprising:

an elastic member, said elastic member being press-contacted to a surface of the member to be charged; and electroconductive particles carried on the surface of the elastic member to which a charging voltage is applied;

wherein a triboelectric charging property of the member to be charged relative to said elastic member is the same as a charging polarity of said charging apparatus.

2. A charging apparatus according to claim 1, wherein said elastic member slides relative to the member to be charged.

3. A charging apparatus according to claim 2, wherein a moving direction of said elastic member is opposite from that of the member to be charged.

4. A charging apparatus according to claim 1, wherein said electroconductive particles have a volume resistivity of not more than $1\times10^{12}$ ohm.cm.

5. A charging apparatus according to claim 4, wherein said electroconductive particles have a volume resistivity of not more than $1\times10^{10}$ ohm.cm.

6. A charging apparatus according to claim 1, wherein said electroconductive particles are non-magnetic.

7. A charging apparatus according to claim 1, wherein said elastic member has a surface foam layer.

8. A charging apparatus according to claim 1, wherein said electroconductive particles cover 60–95% of the surface of the elastic member.

9. A charging apparatus according to claim 1, wherein electric charge is injected from said elastic member into said member to be charged through said electroconductive particles.

* * * * *